US005406056A

United States Patent [19]

Hawley et al.

[11] Patent Number: 5,406,056

[45] Date of Patent: Apr. 11, 1995

[54] ELECTROMAGNETIC CURING APPARATUS AND METHOD OF USE

[75] Inventors: Martin C. Hawley; Jianghua Wei; Valerie Adegbite, all of East Lansing, Mich.; Yawchang Chang, Chicago, Ill.

[73] Assignee: Board of Trustees operating Michigan State University, East Lansing, Mich.

[21] Appl. No.: 236,027

[22] Filed: May 2, 1994

[51] Int. Cl.[6] ..... H05B 6/78; H05B 6/76

[52] U.S. Cl. ..... 219/693; 219/699; 219/696; 219/738; 264/25; 425/174.8 R

[58] Field of Search ..... 219/693, 698, 699, 700, 219/701, 695, 696, 738; 264/25, 26, 27; 425/174.8 R, 174.8 E

[56] References Cited

U.S. PATENT DOCUMENTS

| | | | |
|---|---|---|---|
| 2,627,571 | 2/1953 | Hiehle et al. . | |
| 3,881,403 | 5/1975 | Ingram et al. | 219/701 |
| 4,227,063 | 10/1980 | Edgar et al. . | |
| 4,253,005 | 2/1981 | Gordon et al. . | |
| 4,280,033 | 7/1981 | Wagener et al. | 219/700 |
| 4,477,707 | 10/1984 | Kim . | |
| 4,488,027 | 12/1984 | Dudley et al. . | |
| 4,559,095 | 12/1985 | Babbin . | |
| 4,570,045 | 2/1986 | Jeppson . | |
| 4,714,812 | 12/1987 | Haagensen et al. | 219/697 |
| 4,792,772 | 12/1988 | Asmussen . | |
| 4,861,955 | 8/1989 | Shen . | |
| 4,906,309 | 3/1990 | Bichot et al. . | |
| 4,999,469 | 3/1991 | Dudley et al. . | |
| 5,191,182 | 3/1993 | Gelorme et al. | 219/696 |
| 5,217,656 | 6/1993 | Buckley et al. . | |

OTHER PUBLICATIONS

Wang, C. S., Rubber Division, American Chemical Society, 134–145 (1983).

Lee et al, J. of Composite Materials 18, 387–409 (1984).

Ippen, J., Rubber Chem. Technol. 44, 294 (1971).

Loos, A. C., et al., J. Composite Mat. 17 135–169 (1983).

SAMPE Journal, pp. 33 to 38 (1991).

Proceeding of ICCM/VIII, 1, 10–L (1991).

ANTEC'92 Conf. Proc., 1170 (1992).

*Primary Examiner*—Philip H. Leung

*Attorney, Agent, or Firm*—Ian C. McLeod

[57] ABSTRACT

A microwave apparatus (10) with conductive fingers (104, 105) on extensions (101, 102) contacting the material (200) to be processed and knife edges (100) adjacent the material on opposed sides of the cavity (12). The fingers and knife edges prevent leakage of the microwaves from the cavity (12) through extensions (101 and 102) and can be replaced or modified for various material 200 and die cross-sections. The apparatus is particularly useful for curing electrically conductive resin impregnated fibers.

8 Claims, 4 Drawing Sheets

ELECTROMAGNETIC CURING APPARATUS AND METHOD OF USE

BACKGROUND OF THE INVENTION

1. Field of the Invention

The present invention relates to an improved electromagnetic wave, particularly microwave, curing apparatus and method of use thereof for continuous processing of a material, In particular the present invention relates to an apparatus which prevents leakage of microwaves from the cavity used for the processing.

2. Description of Related Art

The prior art has described various apparatus for continuous processing of materials using microwaves. In each instance spaced metallic projections are mounted adjacent the material being processed without touching it so that there is minimal leakage from the space between the material and the projections. Nevertheless, there is leakage. Illustrative are U.S. Pat. Nos. 2,627,571 to Hiehle et al, 4,253,005 to Gordon et al, 4,227,063 to Edgar et al, 4,477,707 to Kim, 4,488,027 to Dudley et al, 4,559,095 to Babbin, 4,570,045 to Jeppson, 4,861,955 to Shen, 4,906,309 to Bichot et al, 4,999,469 to Dudley et al and 5,217,656 to Buckley et al. These patents only deal with microwave leakage from a cavity in a continuous processing of non-conductive materials. Wei et al described microwave processing of composites at an AICHE meeting in 1990, in SAMPE Journal pages 33 to 38 (1991) in Proceeding of ICCM/VIII 1, 10-L (1991) and in ANTEC '92 Conf. Proc. 1170 (1992). Microwave curing of composites is also described in Lee et al, J. of Composite Materials 18, 387–409 (1984); Ippen, J., Rubber Chem. Technol. 44, 294 (1971); Loos, A. C., et al., J. Composite Mat. 17, 135–169 (1983) and Wang, C. S., Rubber Division, American Chemical Society, 134–145 (1983). The problem is that there is no microwave apparatus available for continuous processing of conductive materials.

OBJECTS

It is therefore an object of the present invention to provide a novel electromagnetic wave apparatus which is adaptable to many different applications for continuous processing. It is further an object of the present invention to provide a microwave apparatus which prevents leakage of microwaves from the cavity used for the continuous processing. It is further an object of the present invention to provide an apparatus which is relatively inexpensive to construct.

These and other objects will become increasingly apparent by reference to the following description and the drawings.

DESCRIPTION OF PREFERRED EMBODIMENTS

Figure 1:
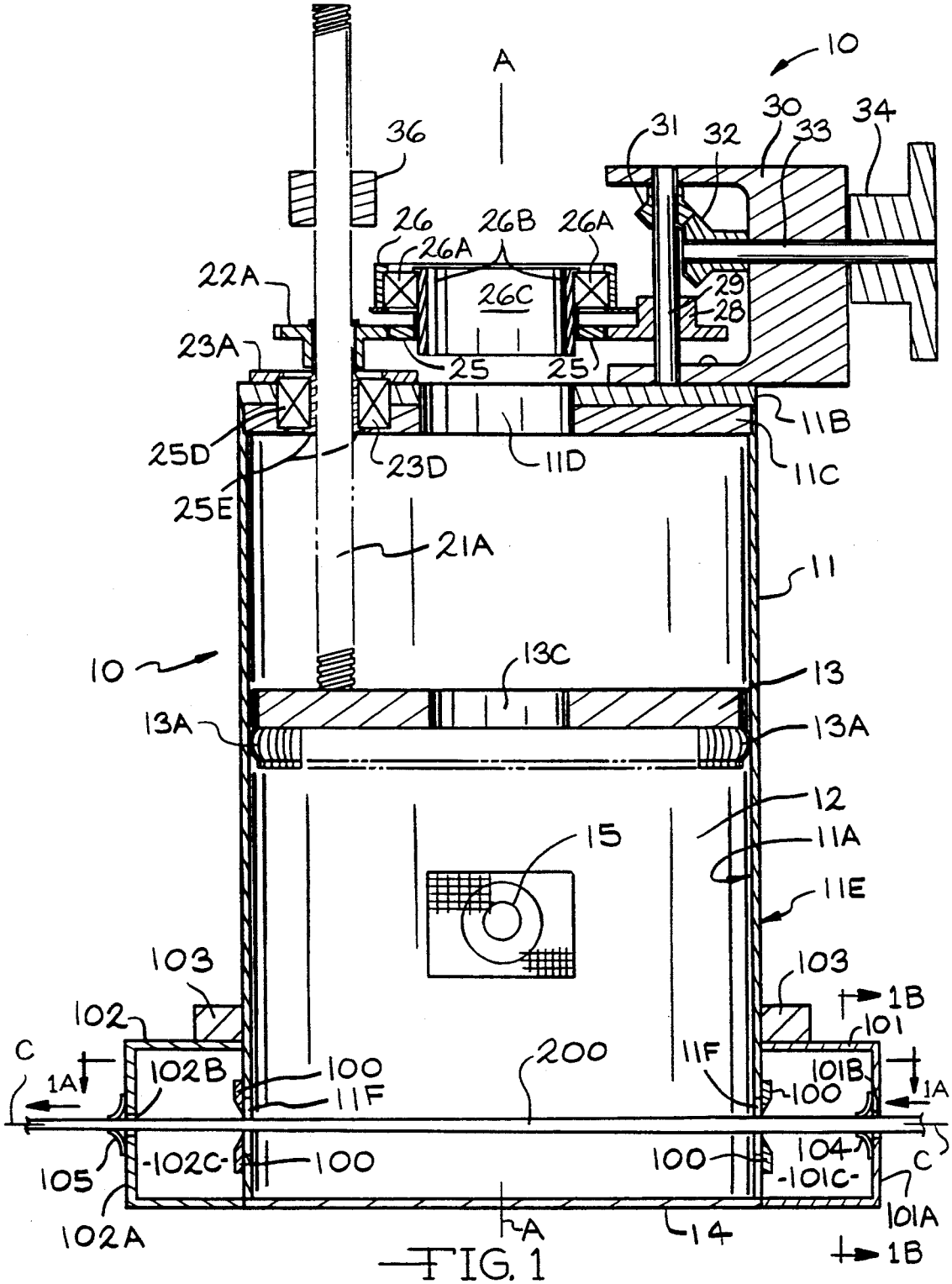
FIG. 1 is a front cross-sectional view of the apparatus 10 of the present invention, particularly illustrating conductive knife edges 100 and with extensions 101 and 102 supporting fingers 104 and 105 in contact with material 200 for confining the microwaves in the cavities 101C and 102C.
Figure 1A:
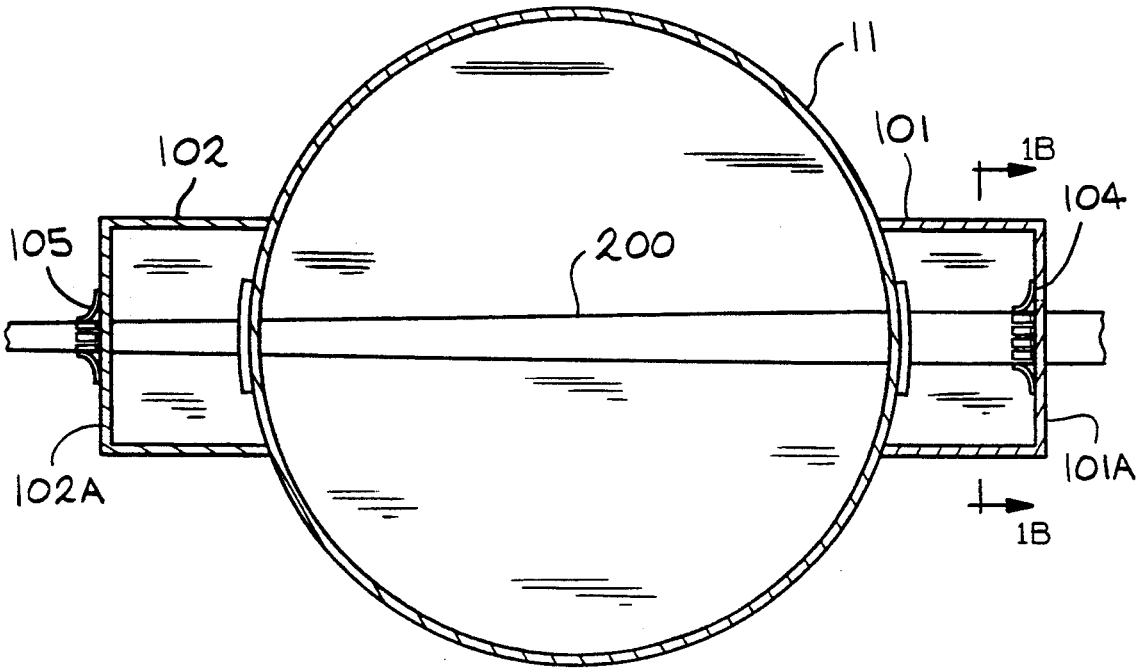
FIG. 1A is a cross-section along 1A—1A of FIG. 1.
Figure 1B:
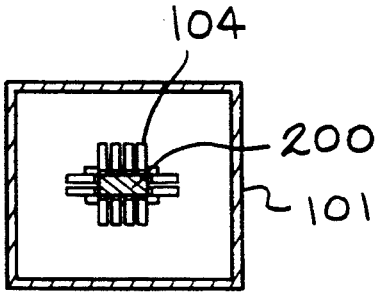
FIG. 1B is a cross section along 1B—1B of FIG. 1.

The present invention relates to an electromagnetic wave generating apparatus including a metallic electromagnetic wave cavity defined by at least one wall which cavity is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the electromagnetic wave to the cavity and control means for moving the probe means and plate means in order to select and control the mode of the electromagnetic wave in the cavity the improvement which comprises: conductive knife edges mounted on the cavity defining an opening through opposed portions of the wall of the cavity along a longitudinal axis of the cavity such that a continuous material can be moved through the openings in closely spaced relationship to the knife edges; a metallic extension having a proximal end mounted on each of the opposed portions of the wall of the cavity so as to surround the material to be treated and extend away from the wall and openings at a distal end of each of the housings of each extension providing a window to be aligned along and with the longitudinal axis of the material; and conductive projections mounted around the openings of each of the extensions so as to surround and contact an outside surface around the cross-section of the material to be processed.

Further, the present invention relates to a method for curing of a continuous material which contains electrically conductive fibers which comprises: an electromagnetic wave generating apparatus including a metallic electromagnetic wave cavity defined by at least one wall which cavity is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the electromagnetic wave to the cavity and control means for moving the probe means and plate means in order to select and control the mode of the electromagnetic wave in the cavity the improvement which comprises conductive knife edges mounted on the cavity defining an opening through opposed portions of the wall of the cavity along a longitudinal axis of the cavity such that a continuous material can be moved through the openings in closely spaced relationship to the knife edges; a metallic extension having a proximal end mounted on each of the opposed portions of the wall of the cavity so as to surround the material to be treated and extend away from the wall and having openings at a distal end of each of the housings of each extension providing a window to be aligned along and with the longitudinal axis of the material; and conductive projections mounted around the openings of each of the extensions so as to surround and contact an outside surface around the cross-section of the material to be processed; providing the material in contact with the projections on the frame means to prevent leakage of microwaves from the cavity; feeding the material through the openings defined by knife edges and the fingers so that the material is cured by the microwaves, wherein the projections prevent the microwaves from leaking from the cavity and the extensions.

The preferred electromagnetic wave energy is microwave.

Unlike a waveguide, a resonant microwave cavity can be tuned to the optimum heating patterns which are corresponding to the heating modes for different processed materials. The microwave apparatus of method of the present invention is fundamentally different from the preheating and postcuring methods of the prior art. The microwave energy heats materials directly to the material while they are pulled through the microwave cavity.

Figure 2:
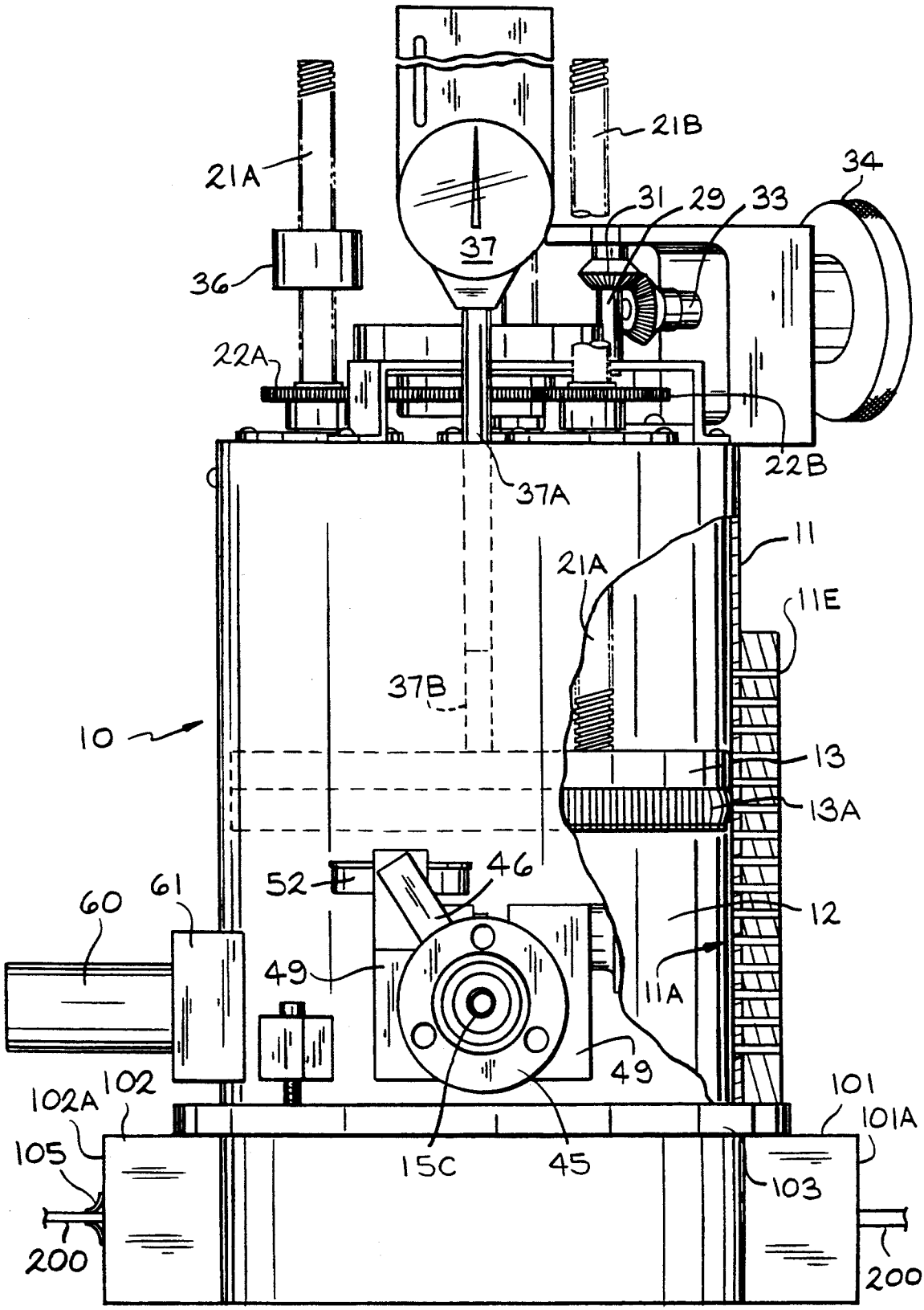
FIG. 2 is a rear view in partial section of the apparatus 10 of FIG. 1.
Figure 3:
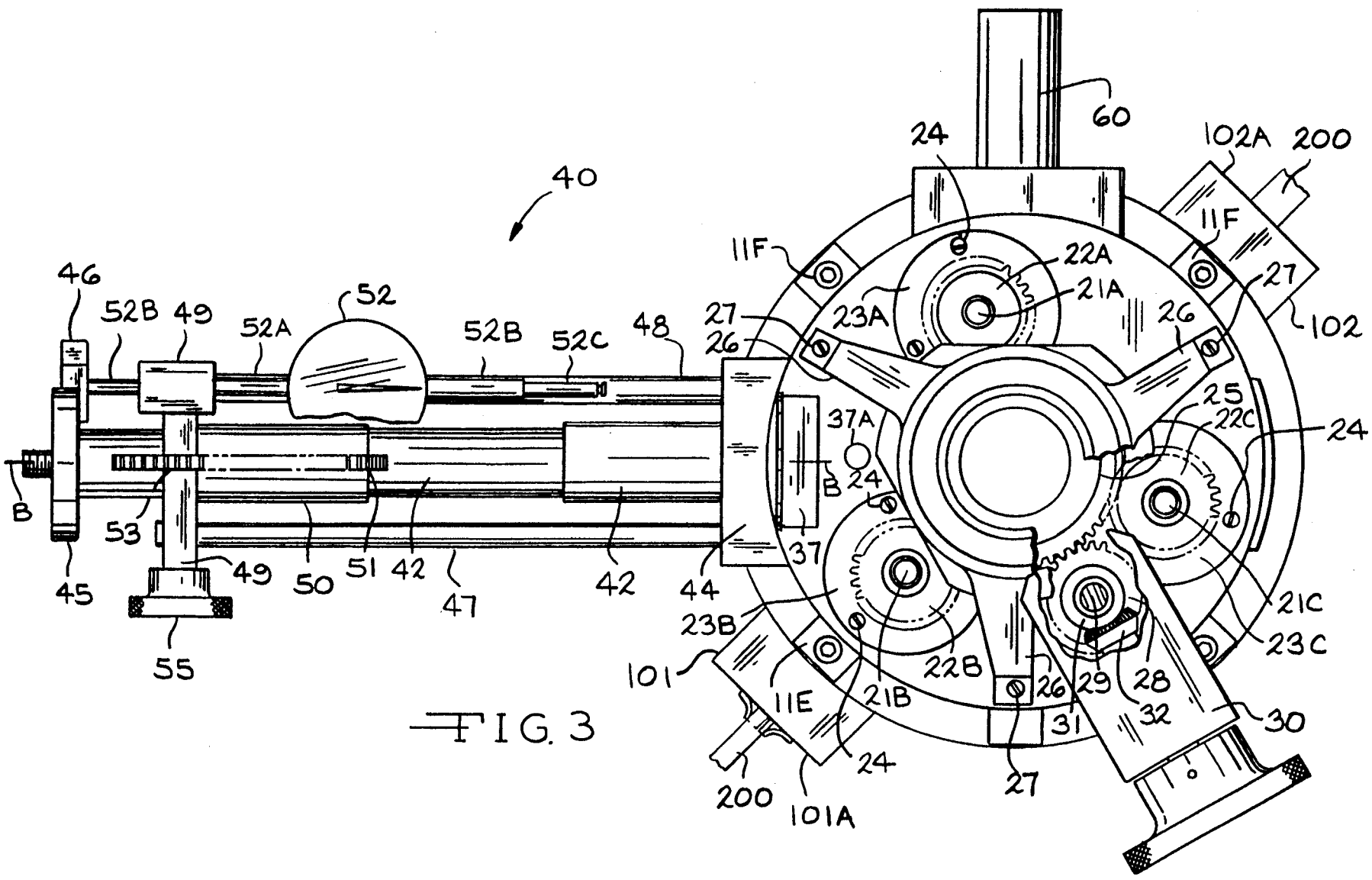
FIG. 3 is a plan view of the apparatus of FIG. 1 showing adjusting mechanisms 40 and 20 for the probe 15 and for the sliding short 13, respectively.

FIGS. 1 to 3 show the preferred general electromagnetic wave generating apparatus 10 of the present invention using the application as described in U.S. Pat. No. 4,792,772. A circularly cross-sectioned, electrically conductive housing 11 defines a cavity 12 around central longitudinal axis A—A for the electromagnetic wave along with a moveable plate 13 and a fixed plate 14 which are also electrically conductive. Conductive fingers (preferably metallic) 13A engage an inside wall 11A of the housing 11. A probe 15 (FIG. 1) is moveable into and out of the cavity 12 and couples the electromagnetic wave to the cavity 12. The cavity 12 is closed. The apparatus is used for electromagnetic wave processing in chamber 12. The fixed plate 14 is secured to a vacuum source (not shown).

The mechanisms 20 and 40 are provided for moving the probe 15 and moveable plate 13 in the cavity 12. The mechanism 20 includes three externally threaded posts 21A, 21B and 21C attached to the plate 13 and mounted through a top portion 11B of the housing 11. As shown in FIG. 3, planetary gears 22A, 22B and 22C are rotatably mounted on the top portion 11B of the housing 11 on internal cover 11C by means of support members 23A, 23B and 23C and screws 24. The support member 23A includes a bearing 23D and spindle 23F supporting gear 22A. Support members 23B and 23C are constructed in the same manner. Central gear 25 is rotatably mounted around the central axis A—A on bracket 26 on top portion 11B by means of screws 27. Bracket 26 includes a bearing 26A and spindle 26B which mounts central gear 25 so as to engage each of the planetary gears 22A, 22B and 22C. A side gear 28 engages the central gear and is mounted on a shaft 29. The shaft 29 is mounted in a C-shaped member 30. First bevel gear 31 is mounted on shaft 29 and is engaged by second bevel gear 32 mounted on shaft 33 and rotatably supported at right angles to shaft 29 on C-shaped member 30. A rotatable knob 34 is secured to shaft 33 and includes indicia (not shown) for determining increments of position of the knob 34 relative to the C-shaped member 30. Stop 36 is in threaded engagement with shaft 21A to prevent movement of the plate 13 beyond a particular point in the cavity 12. As can be seen from FIGS. 1 to 3, the plate 13 is moved along central axis A—A by turning knob 34 which rotates shaft 33, first and second bevel gears 31 and 32, shaft 29, side gear 28, central gear 25 and then planetary gears 22A, 22B and 22C which move posts 21A, 21B and 21C vertically and plate 13. The knob 34 can be controlled manually or it can be controlled by a motor (not shown). The central gear 25, spindle 26B has an opening 26C along the axis A—A which can be used for inserting a quartz tube (not shown) for a confining plasma or an object to be treated with the electromagnetic waves in cavity 12, but which is not used in the present invention. The top portions 11B and internal cover 11C have a central opening 11D and the plate 13 optionally has an internal opening 13C to provide access to cavity 12. A micrometer 37 with a fixed stem 32A is secured to top portion 11B and a moveable stem 37B engages the plate 14. Openings 11E are provided for sensors (not shown) to determine the electrical field strength within the cavity 12 at various positions and spacings from the axis A—A. As the plate 13 moves, the micrometer 37 measures the change in position.

The mechanism 40 controls the probe 15. The probe 15 is mounted perpendicular to the central axis A—A on axis B—B (FIG. 3) and is moveable into and out of the cavity 10 in tube 42 thereby rigidly mounting the probe 15. The probe 15 is constructed as described in U.S. Pat. No. 4,792,772. The tube 42 is mounted on the housing 11 by means of block 44 so that the tube 42 slides into and out of the receiver 43. The tube 42 includes an electrical connector 45 with a projection 46 perpendicular to the axis B—B. Posts 47 and 48 are mounted parallel to the axis B—B. A holder 49 is mounted on the posts 47 and 48 and slidably supports the tube 42. A sleeve 50 mounts a rack 51 on the tube 42. The holder 49 supports a micrometer 52 with a fixed stem 52A and a moveable stem 52B which engages the projection 46. The position of the moveable stem 52B can be adjusted by means of adjuster 52C on support 52D of the micrometer 52. Knob 55 is used to rate the gear 53 and thus move the probe 15 into and out of the cavity 12. In operation the knob 55 can be controlled manually or by a motor (not shown).

As can be seen from FIGS. 1 to 4, the control of the probe 15 and plate 13 is by means of knobs 34 and 55. The result is a very simple and precise means of making micrometer adjustments of the probe 15 and plate 13 in the cavity 12. This allows the selection of the mode of the electromagnetic wave as well as adjustments to provide fine tuning within a mode. Micrometers with a digital readout (not shown) can be used. Motors (not shown) can be used to move the plate 13 and probe 15. The result is a very useful and commercially acceptable microwave cavity.

FIG. 1 shows the knife edges 100 around an opening 11F in cavity 11 along axis C—C. A continuous length of material 200 being treated is moved between the knife edges 100 along axis C—C. Rectangular cross-sectioned extensions 101 and 102 are mounted on the outer wall 11E on ring 103 with end plates 101A and 102A and openings 101B and 102B along axis C—C. Flexible metallic fingers 104 and 105 (copper or other metal) are mounted on each of the end plates 101A and 102A so as to surround the material 200 being processed. Other conductive projections, which contact the material 200 can be used. Both the projections and the knife edges can be adjustable to accommodate different materials 200.

In operation, the material 200 is inserted through the knife edges 100 and openings 101B and 102B so that the fingers 104 and 105 slide on the material 200 around a cross-section of the material 200. The material 200 is then pulled through the knife edges 100 and fingers 104 and 105 using conventional rollers or the like (not shown).

The microwave resonant modes were located using a swept frequency oscillator. A single frequency (2.45 GHz) power source was used for heating and curing tests. The input and reflected power were measured on-line during processing. The microwave cavity 12 was kept tuned by adjusting the cavity length (Lc) and coupling probe depth (Lp) so that the reflected power is minimum. A 17.78 cm inner diameter tunable cylindrical batch microwave cavity was modified for the processing of the material 200.

The preferred continuous material 200 was a prepreg of a graphite fiber and epoxy prepreg (Hercules AS4/3501-6 (Hercules, Inc., Magna, Vt.). This material is conductive, the fingers 104 and 105 effectively seal the ends 101A and 102A of the extensions 101 and 102. Other such conductive materials made of continuous metal or carbon fibers with a resin can be used. The apparatus is also effective with non-conductive continuous materials 200, particularly fiberglass prepregs. Additional duplicate extensions may be attached to 101 and 102 to further control microwave leakage. The result is that the microwaves do not leak from the apparatus 10 and the material 200 is effectively cured.

It is intended that the foregoing description be only illustrative of the present invention and that the present invention be limited only by the hereinafter appended claims.

We claim:

1. In an electromagnetic wave generating apparatus including a metallic electromagnetic wave cavity defined by at least one wall which cavity is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the electromagnetic wave to the cavity and control means for moving the probe means and plate means in order to select and control the mode of the electromagnetic wave in the cavity the improvement which comprises:

(a) conductive knife edges mounted on the cavity defining an opening through opposed portions of the wall of the cavity along a longitudinal axis of the cavity such that a continuous material can be moved through the openings in closely spaced relationship to the knife edges;

(b) a metallic extension having a proximal end mounted on each of the opposed portions of the wall of the cavity so as to surround the material to be treated and extend away from the wall and having openings at a distal end of each of the housings of each extension providing a window to be aligned along and with the longitudinal axis of the material; and (c) conductive projections mounted around the openings of each of the extensions so as to surround and contact an outside surface around the cross-section of the material to be processed.

2. The apparatus of claim 1 wherein the projections are flexible metallic fingers and wherein the material is comprised of conductive fibers.

3. The apparatus of claim 2 wherein the fingers are copper.

4. The apparatus of claim 1 wherein both conductive knife edges and the projections in the openings in the extensions are adjustable to accommodate changes for different configurations and cross-sections of the material to be processed.

5. A method for curing of a continuous material which contains electrically conductive fibers which comprises:

(a) an electromagnetic wave generating apparatus including a metallic electromagnetic wave cavity defined by at least one wall which cavity is excited in one or more of its modes of resonance in the cavity around a central axis of the cavity including moveable plate means in the cavity mounted perpendicular to the central axis in the cavity and moveable along the central axis, moveable probe means connected to and extending inside the cavity for coupling the electromagnetic wave to the cavity and control means for moving the probe means and plate means in order to select and control the mode of the electromagnetic wave in the cavity the improvement which comprises conductive knife edges mounted on the cavity defining an opening through opposed of portions the wall of the cavity along a longitudinal axis of the cavity such that a continuous material can be moved through the openings in closely spaced relationship to the knife edges; metallic extension having a proximal end mounted on each of the opposed portions of the wall of the cavity so as to surround the material to be treated and extend away from the wall and having openings at a distal end of each of the housings of each extension providing a window to be aligned along and with the longitudinal axis of the material; and conductive projections mounted around the openings of each of the extensions so as to surround and contact an outside surface around the cross-section of the material to be processed;

(b) providing the material in contact with the projections on the extensions to prevent leakage of microwaves from the cavity;

(c) feeding the material through the openings defined by knife edges and the projections so that the material is cured by the microwaves, wherein the projections prevent the microwaves from leaking from the cavity and the extensions.

6. The method of claim 5 wherein the material being processed is electrically conductive so that the projections and the material together prevent the microwaves from escaping from the cavity as the material is processed.

7. The method of claim 5 wherein the probe and plate means are adjusted as the material is processed in order to cure the material.

8. The method of claim 5 wherein both the conductive knife edges and the openings in the extensions are adjusted to accommodate changes for different configurations and cross-sections of the material being processed.

* * * * *

UNITED STATES PATENT AND TRADEMARK OFFICE

CERTIFICATE OF CORRECTION

PATENT NO. : 5,406,056

DATED : April 11, 1995

INVENTOR(S) : Martin C. Hawley, Jianghua Wei, Valerie Adegbite and Yawchang Chang It is certified that error appears in the above—identified patent and that said Letters Patent is hereby corrected as shown below:

Column 1, line 11, after "material" and before "In", the comma"," should be a period --.--.

Column 6, line 26 (Claim 5), "through opposed of portions the wall" should read --through opposed portions of the wall--.

Signed and Sealed this

Fifteenth Day of August, 1995

Bruce Lehman

*Attest:*

BRUCE LEHMAN

*Attesting Officer*

*Commissioner of Patents and Trademarks*